US005152638A

United States Patent [19]

Trevisani

[11] Patent Number: 5,152,638

[45] Date of Patent: Oct. 6, 1992

[54] PROCESS AND APPARATUS FOR EXCAVATING TUNNELS

[75] Inventor: Davide Trevisani, Cesena, Italy

[73] Assignee: Trevi S.p.A., Cesena, Italy

[21] Appl. No.: 696,604

[22] Filed: May 7, 1991

[30] Foreign Application Priority Data

May 11, 1990 [IT] Italy ..... 67347 A/90

[51] Int. Cl.[5] ..... E21D 9/04

[52] U.S. Cl. ..... 405/140; 405/145

[58] Field of Search ..... 405/138, 140, 141, 142, 405/145, 146, 150, 150.1

[56] References Cited

U.S. PATENT DOCUMENTS 3,597,929 8/1971 Bodine ..... 405/140
3,640,077 2/1972 Watson et al. ..... 405/140
4,055,959 11/1977 Fritz ..... 405/145
4,459,064 7/1984 Berset ..... 405/138
4,666,336 5/1987 Murakami et al. ..... 405/138

*Primary Examiner*—David H. Corbin
*Attorney, Agent, or Firm*—Bachman & LaPointe

[57] ABSTRACT

A machine for consolidating the soil for underground drilling excavations by means of the technique of the protective umbrella comprises a frame or chassis mounted on ground engaging motor driven crawler tracks and is provided with pistons having stabilizing feet. A power unit, which works a rotary unit and auxiliary units, is used for moving and positioning the machine. A rotary unit is located on a boom mounted on one end of telescopic standards hinged to the other end of the frame, around an axis that is substantially parallel with respect to the longitudinal axis of the machine. The standards are fixed to step bearings that realize said hinge and that are able to pivot with a 180 degree angle under the action of an engine. Said bearings have cursors sliding along vertical slides of the frame.

13 Claims, 8 Drawing Sheets

PROCESS AND APPARATUS FOR EXCAVATING TUNNELS

DESCRIPTION

This invention refers generally to a machine used for preventive consolidation of the soil for underground drilling excavations by means of the so-called technique of the protective umbrella.

Among the techniques that are already known for preventive consolidation of underground drilling excavations in particularly unstable types of soil, there is that one called the protective umbrella, which consists in inserting in the soil rays of steel tubes provided with nonreturn valves to execute injections of soil stabilizing mixtures, mainly concrete.

This structure, known as protective umbrella, begins working when the soil underneath is removed and the soil above is therefore substained by the umbrella.

Machines that are actually used for this purpose present in their structure some limitations which slow down the works and need a constant attendance of engineers and workmen who have to correct the position and the orientation of the machine when it is working.

It is a purpose of the invention to propose a machine employed to consolidate the soil in underground drilling excavations which comprises systems that allow correct positioning and assure continuous functioning during the whole cycle of operation with no further need of engineers and workmen.

The known technique requires a long time for the tubes to be inserted in the soil, and the soil surrounding the tubes gets too upset, mainly because of the great diameter of the drillings that are necessary for placing the reinforcements for the realization of the piles. It is also a purpose of the invention to propose three processes that may be realized with the machine which is object of the invention and that reduce the inconveniences of actual technology, making the process very convenient compared to other technologies.

The machine and the processes in accordance with the present invention, are now going to be described in two alternative realizations referring to the drawings.

A frame 10 which forms the carrying structure of the machine is mounted on a motor driven tracked vehicle 11 and provided with pistons 12 having stabilizing feet.

Figure 1:
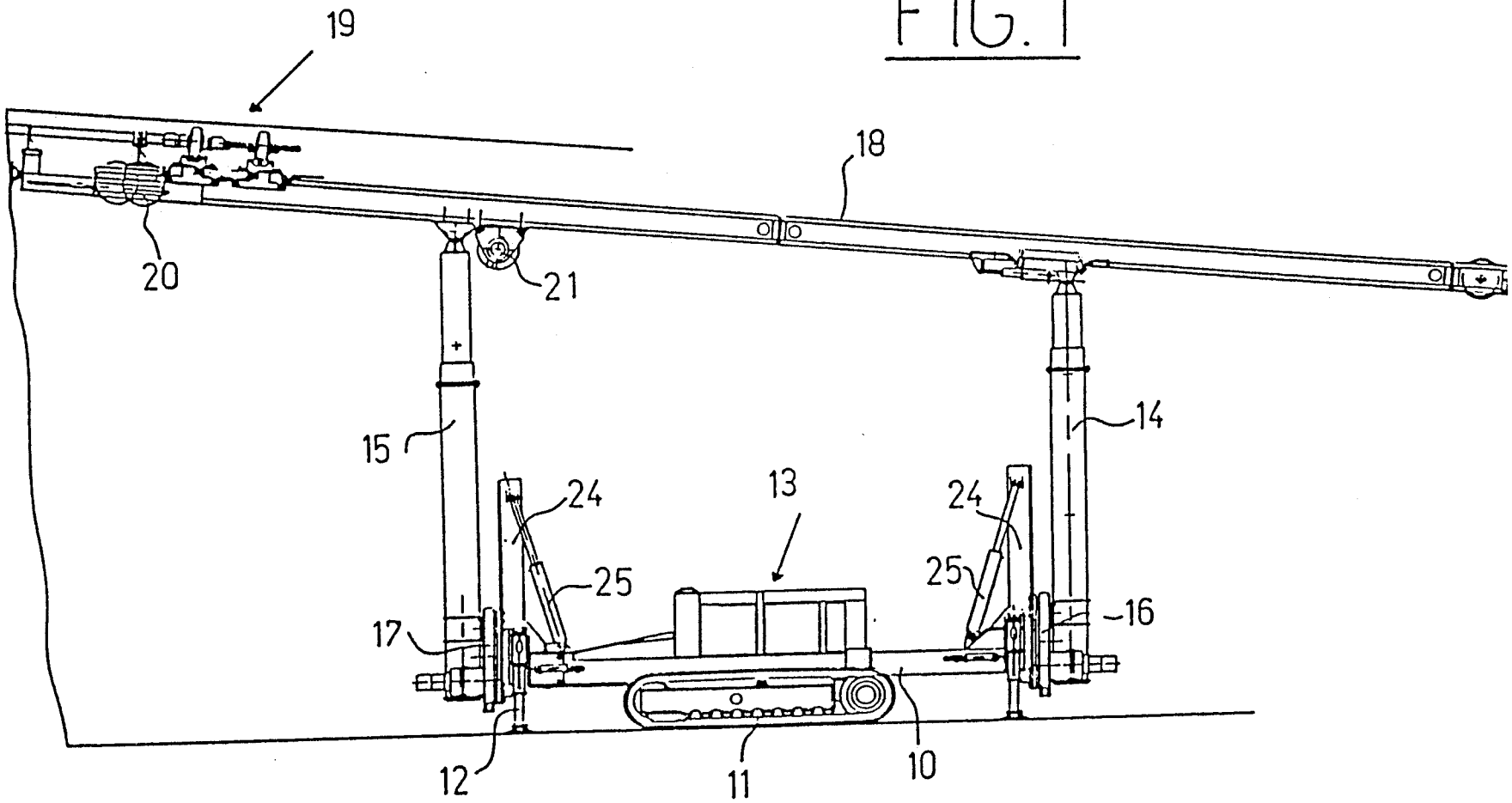
FIGS. 1 and 2 are respectively a front and a side view of the machine in accordance with a first embodiment of the invention.
Figure 2:
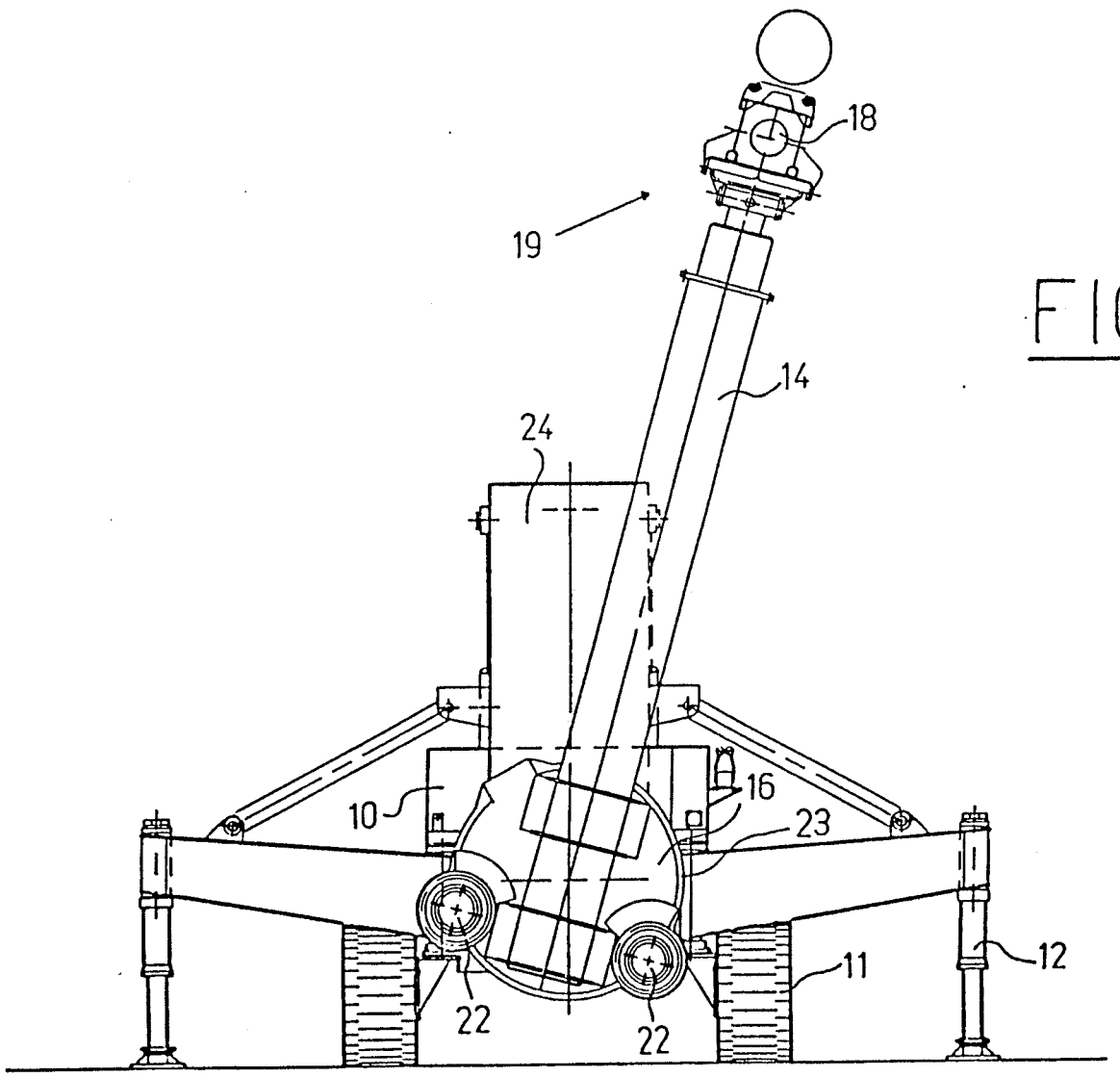

A central power unit 13 is located on top of the frame 10 and it works the rotary working unit and the auxiliary units used for moving and positioning the machine. As shown in FIGS. 1 and 2, the working unit is single and it is formed by two telescopic standards 14 and 15 which are integral, at one extremity, with respective plates 16 and 17 and at the other extremity with a boom 16. Said boom is provided with a working unit 19, an engine 20 and a windlass 21 for moving the engine 20.

The plates 16 and 17 that support the telescopic standards 14 and 15 are also provided with engines 22 wherein the pinions rotate on a toothed circumference 23 which is part of the plates.

The plates are provided with an internal cursor that is able to slide along slides 24 that are vertical when the machine is working (see FIGS. 1 and 2) and are turned down in a horizontal position for transport. For this purpose, the slides 24 are pivotally connected to the frame 10 and to the pistons 25 which are worked by the power unit 13, and meant to rotate horizontally the slides 24 and the standards 14 and 15 from which the boom 18 has to be previously removed.

Figure 3:
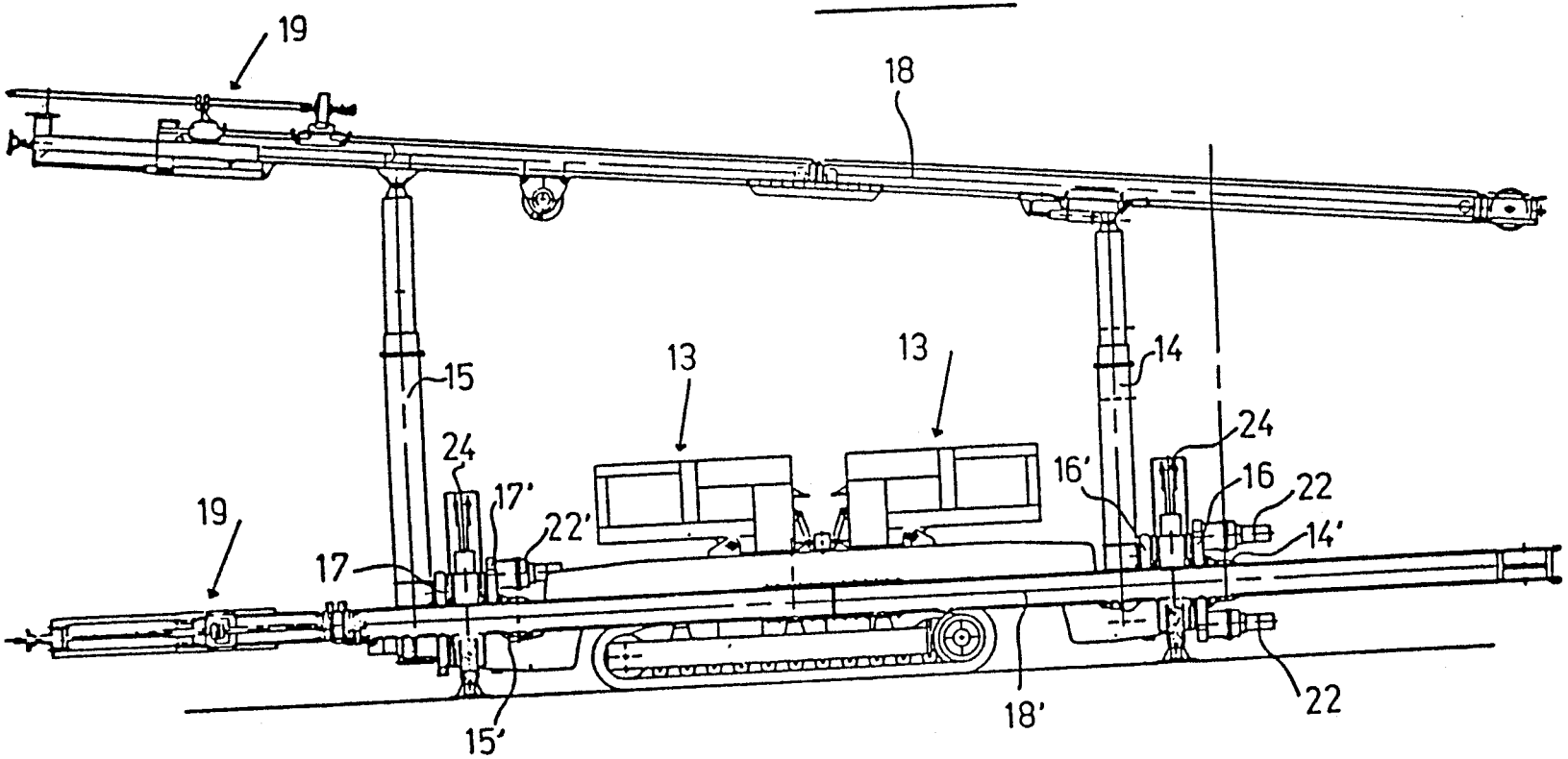
FIGS. 3 and 4 are views of the machine as FIGS. 1 and 2 in accordance with a second embodiment of the invention.
Figure 4:
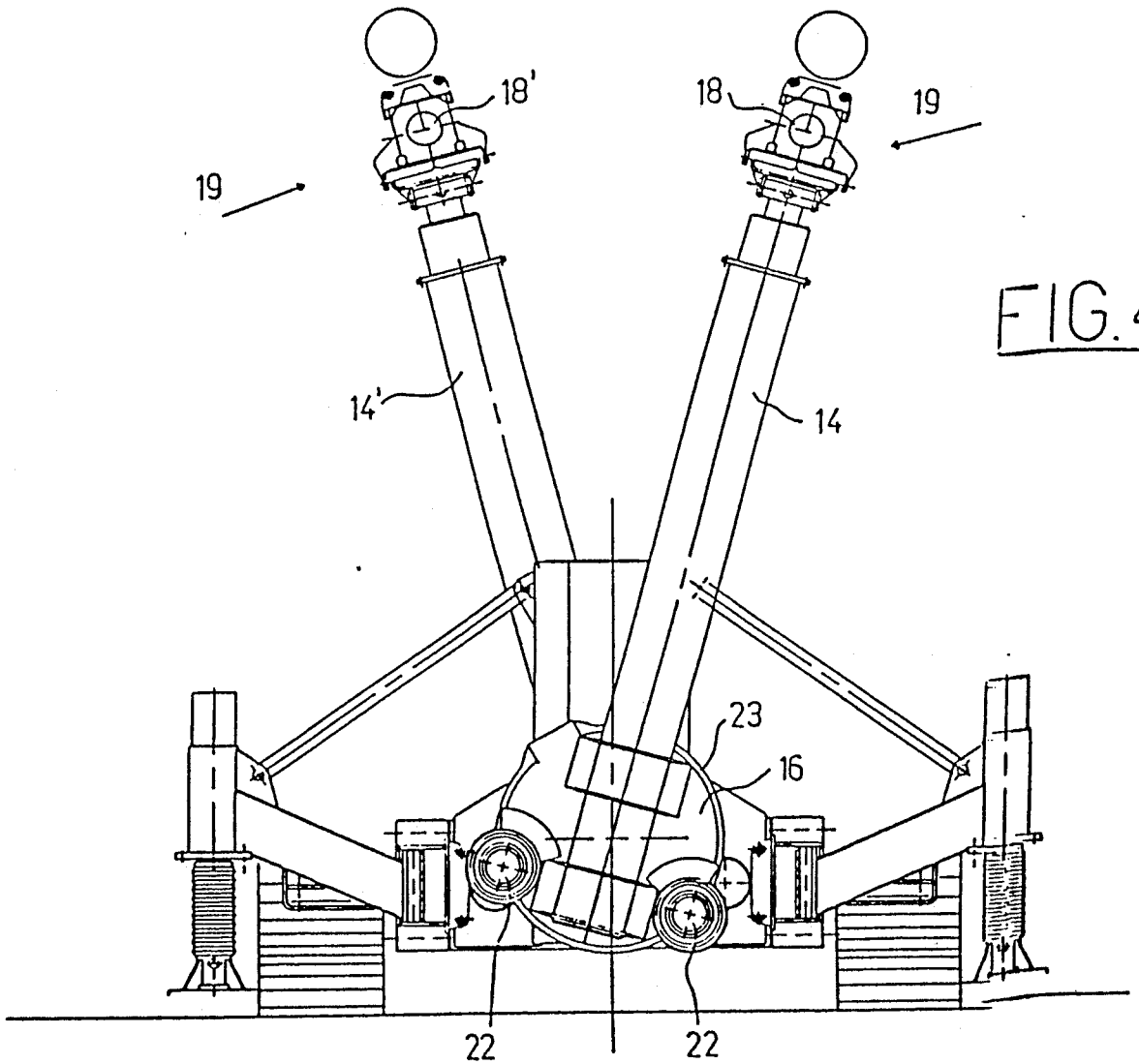

In the embodiment shown in FIGS. 3 and 4, the working units 19 are two, so these are two couples of standards 14, 15 and 14', 15' carrying respectively the booms 18 and 18'.

In this case the plates will be mounted in couples on one side 16 and 16' and on the other side 17 and 17'.

Each couple of plates is meant to substain the respective standards of both working units; besides, each couple of plates or thrust bearing 16, 16' and 17, 17' is arranged so that the respective cursors are able to slide on the two opposite sides of the slide 24 that will therefore find itself in an intermediate position between the plates. The standards 14, 15 of one working unit 18 will be staggered in comparison with the standards 14', 15' of the other working unit 18' to allow both units to rotate with an angle of about 180 degrees in relation to the lenghtwise axis of the machine.

In the embodiment shown in FIGS. 3 and 4, the slides 24 cannot be turned down horizontally as in the embodiment of FIGS. 1 and 2 because of the presence of plates 16, 16' and 17, 17' that are located on both of their sides.

The engines 22 and 22' (see FIG. 3) are mounted in couples on both the sides of the machine, each couple of which is ment to work respective toothed plates 16, 16' and 17, 17' and also the standards 14, 14' and 15, 15' that are connected with them.

This arrangment of the engines and their number is not a restrictive charactheristic because their location as well as their number or their connection could be changed following different embodiments of the machine, depending on different necessities.

The slides 24 allow the standards to transfer vertically in such a manner that the lenghtwise axis of the tunnel can be centred before the works on the vault of the gallery take place. This performance of the machine has the effect that no matter on what surface the crawler tracks are placed before the centering because this can be executed directly by the standards by means of the slides on which they can transfer.

The standards 14, 14' and 15, 15' are able to rotate radially in accordance with the radius of the consolidation that is being executed in the vault of the tunnel without any further movements around the rotation axis. If the machine is of the type with a double boom 18 (see FIGS. 3 and 4) the vault may be divided by working on one side with one boom and the other side with the other boom, or else if the drillings are being executed following two different ranges, each boom may be used for one range only and therefore its working unit is used to drill the whole vault.

Another alternative characteristic is that one boom can drill with one type of drilling head while the other boom is positioning the reinforcements with another kind of head in the boreholes. It is also possible to mount a rotary rock hammer on the boom 18 and on the other boom a top hammer or a rotary drill for executing jet grountings, which can be reinforced or not.

The standards are rotated radially by means of the plates or thrust bearings 16 and 17, which are one independent from the other and they permit a movement of a 180 degree angle and more, until each standard reaches the surface on which the crawler tracks are placed upon.

Another advantage is in the fact that in case of breakdown of one of the rotary units 19, the machine is still able to work with only one of the rotary units in the case of the equipment with a double boom (see FIGS. 3 and 4).

This machine makes it easy to place the boreholes exactly: in fact the machine is positioned in the middle of the tunnel with its crawler tracks. This is obtained by following the axis of the tunnel or the axis of each segment of a broken line-axis if the tunnel is curved.

The axis of symmetry of the machine carries an indicator that during the positioning of the machine follows the axis of the tunnel traced out by a topographer.

Once the machine is positioned with its stabilizers, the centre of the vault has to be found (or the centres if the tunnel is inclined), and the centres of the plates 16 and 17 have to be positioned by making them slide on the slides 24 until their centres coincide with the centres of the vault.

During this phase the pistons supporting the telescopic standards that hold the working units 19 are closed, so a graduated ring mounted on each standard indicates zero.

The positioning of the standards for executing boreholes according to the angle that is required for the consolidation of the vault having the shape of a truncated cone (or of the scales of a fish), is realized by sliding the pistons connected with the standards of the right lenght and positioning the graduated rings, according to the values previously set out by the engineers that fill in the schedules related to each borehole, in accordance with the angle requested by the topographer.

This machine according to the invention makes it possible to realize a first process for preventive consolidation of the soil for underground mining with the technique of the protective umbrella, exploiting an equipment which comprehends: a metallic tube of reinforcement, a tubular rod provided with nozzles, piercing bit and a double rotary unit.

The process comprehends the following phases:

a) mainly sub-horizontal drilling of the soil with the piercing bit coaxially contained inside the tube, said tube and said rod being rotated by a rotary unit;

b) injection of pressurized liquid mixtureres through the nozzles of the rod with the removal of the finest part of the soil that is being consolidated;

c) extraction of the rod from the inside of the tube.

Figure 5:
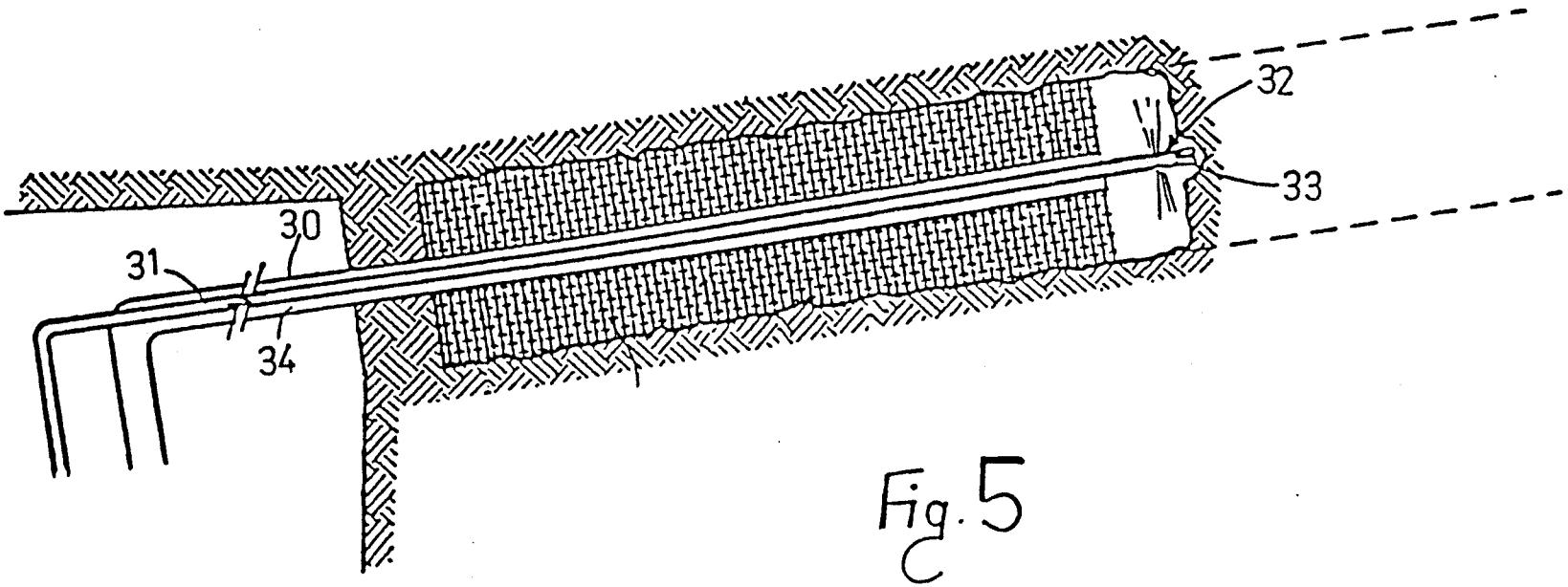
FIG. 5 shows a phase of the first process.
Figure 6:
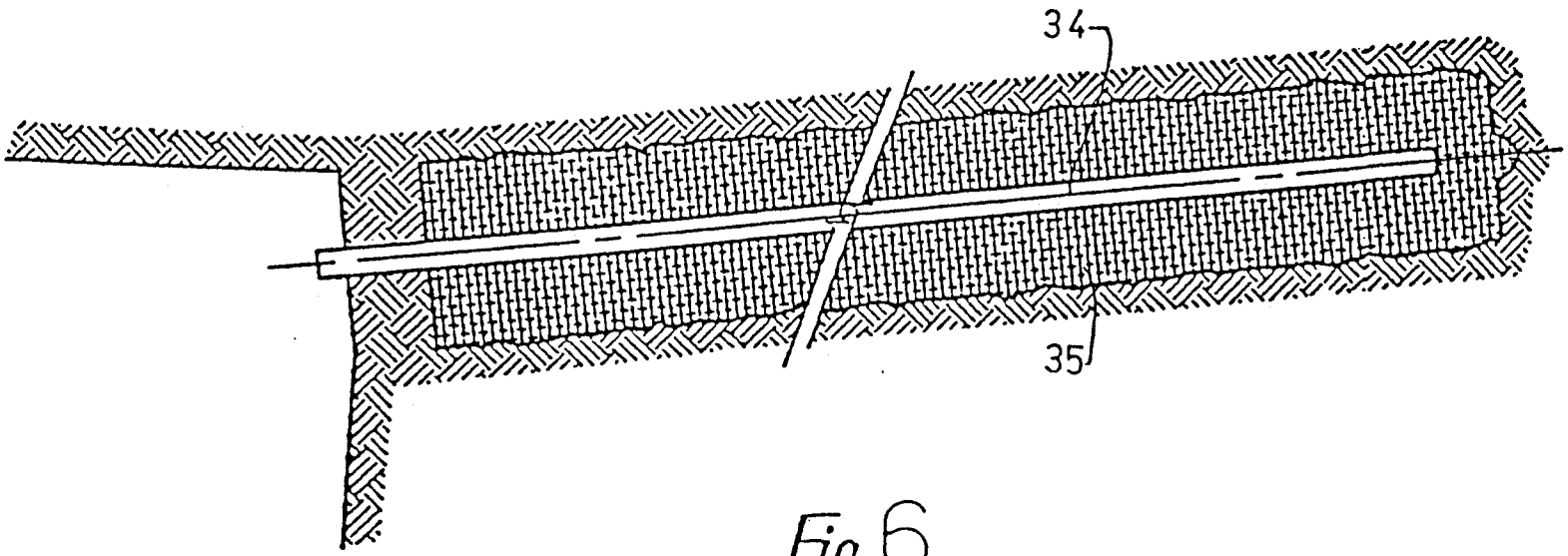
FIG. 6 shows a phase following the one in FIG. 5.
Figure 7:
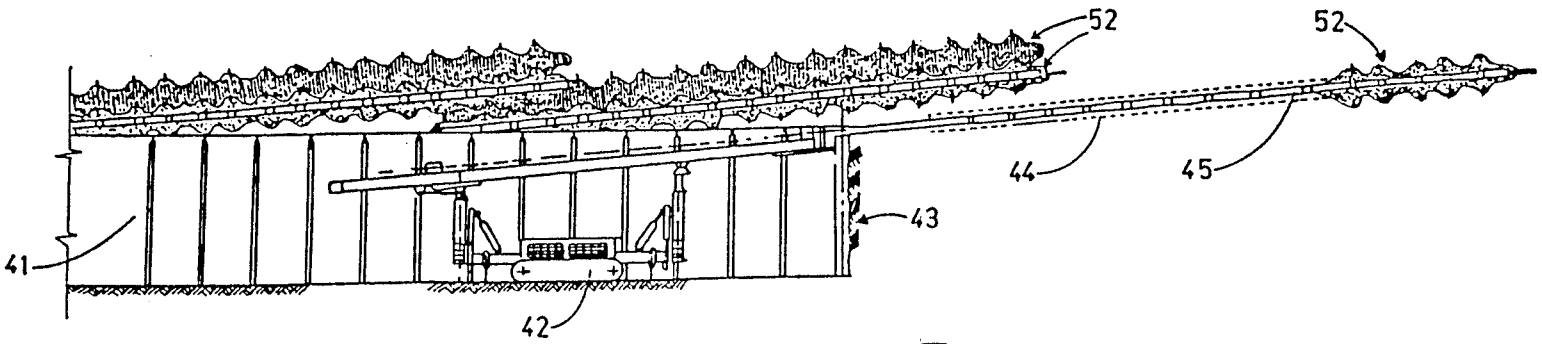
FIG. 7 is a vertical lenghtwise section of the tunnel wherein the vault has been consolidated with the process which is the object of the invention.

With reference to FIGS. 5 and 6, for the realization of the process, a straight metallic tube 30, preferibly made out of steel is used. Said tube has a diameter smaller than the one of the tube 30 and a double rotary head which is not shown in the figures and that is used to rotate both the tube and the rod.

The rod 31 is one and is provided with a boring tool indicated as a whole with 32 which comprises a traditional piercing bit 33 and near this there are nozzles that are distributed radially on the rod and that communicate with the outside.

In operating conditions, the rod 31 is slipped into the tube 30 and is kept coaxial to the tube by the rotary unit. The booring tool 32 is positioned and kept outside the front end of the tube 30 and is directed perpendicularly to the soil that has to be consolidated.

The assemble formed by the rod 31 and the tube 30 is rotated by the rotary unit for piercing the soil and proceed this way. The rotary head forces the rod 31 and the tube 30 to rotate at the same time but in the opposite directions of rotation. For example the rod 31 is rotated while the tube 30 is being rotated.

The material that is produced by the drilling is conveyed towards the outside through the anular hollow space 34 between the rod 31 and the inside annular surface of tube 30.

Simultaneously to the proceeding of the tube 30 and the rod 31 in the soil, high pressurized liquid mixture is injected through the rod, removing the finest part of soil. The mixture flows through the nozzles forming a column 35 of soil and concrete mixture around the tube 30 that later on will stiffen.

When the right lenght of the column 35 is obtained, the rod 31 has to be pulled out of the tube 30 and taken away whereas the tube 30 may be left in the soil so to form columns of reinforced soil.

In a variant of the process, the tube 30 is also pulled out of the ground so that non reinforced columns are realized.

In a favourite form of realization of the first phase of the piercing process, the tube 30 and the rod 31 are forced to advance and spin according to prefixed parameters in a direction substantially oblique compared with the level line so that columns are formed in such a way that they partially lie one over the other like the scales of a fish.

As it can be observed, the process that has been described cuts off some phases of the traditional process establishing a column of consolidated soil in a shorter time.

With reference to FIGS. 7–12, it is possible to realize (utilize) a second process with the machine that is the object of the invention.

By means of a machine 42, drillings 44 are practiced radially on the breast 43, each one of them forming on angle with the vault of the tunnel 41.

Figure 8:
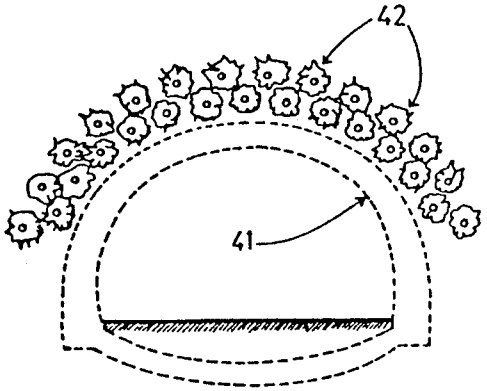
FIG. 8 is a cross, vertical section of the same tunnel.

The drilling may be placed on concentrical layers, as shown in FIG. 8. The drillings are executed by means of tubes 45 opportunely equipped at their end. Said tubes are driven into the soil so that they can convey the consolidating mixtures and act as reinforcements.

Each tube has nozzles 46 located at equal distances disposed on a radial plan and ending on the bottom of a slot 47 that goes round the tube.

A steel ring 48. with elastic charactiristics, is placed inside the slots 47. The ring 48 is open and formed by a strap-iron which has a thickness that is never superior to the deepness of the slot that keeps it, so that it should not stick out of the external surface of the tube.

Figure 9:
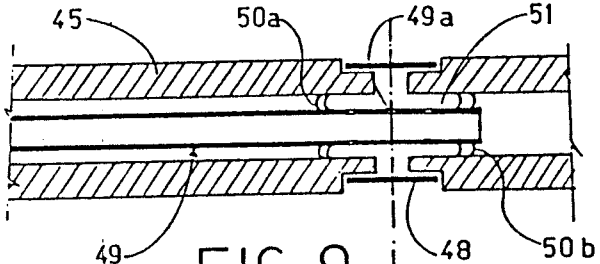
FIG. 9 is a lengthwise section of a reinforcement tube according to the second process.

The injection of the consolidating mixtures in the soil is executed by a tubular rod which is introduced axially inside the tube 45 and is called "packer". Said rod, that in FIG. 9 is indicated with reference number 49, has on its far end two elements 50*a* and 50*b* which are meant to ensure the seal against the internal surface of the tube and to define a chamber 51 communicating with the packer 49 through holes 49*a*. The rod can be connected with the outside by means of valve 48.

The injection is executed beginning on the valve that is the farthest from the entrance of the borehole 44.

For this purpose the rod of packer 49 is positioned so that the sealing elements 50*a* and 50*b* are placed respectively before and after said valve. Therefore the injection begins with a constant pressure of the mixture, that flows out of the tube 45 by the widening of the ring 48. When this phase is over, the injection is executed through the preceding valve, and so on, until the consolidation pile 52 is completed and in which the tube 45 left to act as a permanent reinforcement.

The process also allows the execution of consolidation columns without upsetting the nearby soil. In fact the presence of tube 45 avoids the inevitable relaxation of the soil that does take place with traditional methods that need to recuperate the temporary coating.

In the practical realization of the invention the non return valves may differ from the ones shown here.

Figure 12:
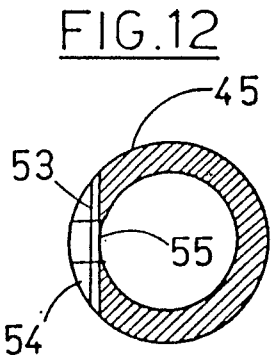
FIG. 12 is a view according to viewing plane B—B of FIG. 11.
Figure 11:
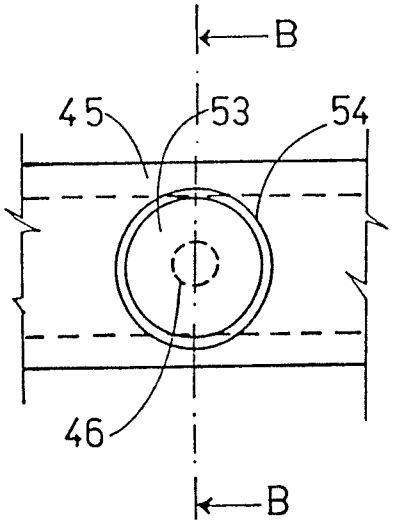
FIG. 11 is a lengthwise section of a reinforcement tube.
Figure 10:
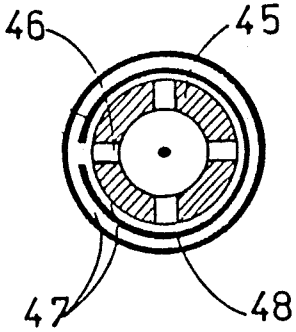
FIG. 10 is a view according to viewing plane A—A of FIG. 9.

FIGS. 11 and 12 show a variant where each valve is made by a circular plate 53 placed in a complementary seat 54 which is obtained on the outside of the tube 45. The plate 53 controls an opening 55 and is opportunely joined to the tube.

Figure 13:
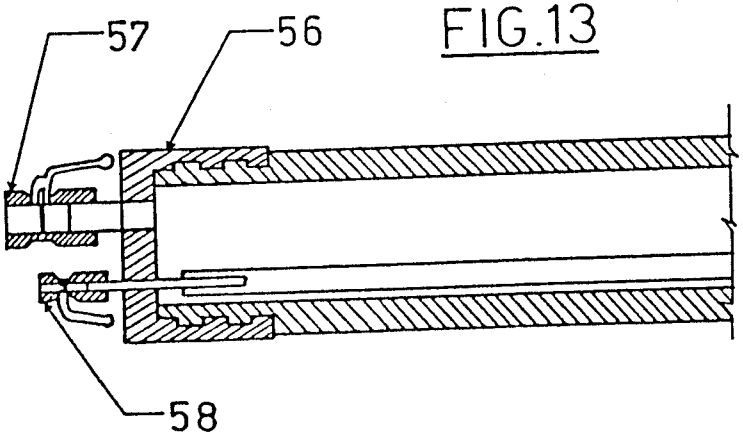
FIG. 13 shows a detail of the equipment that is used in the third process.

As an alternative to the injection by means of valves and of a rod 49 equipped with sealing elements 50*a* and 50*b* as previously described, it is possible to use an alternative process (see FIG. 13).

A cap nut 56, having a delivery valve 57 and an escape valve 58, is placed on the end of each tube that is sticking out of the vault, allowing to put all the nonreturn valves under pressure simultaneously.

I claim:

1. A tunneling apparatus comprising a land vehicle having a frame and at least one working unit mounted thereon, said at least one working unit comprising: guide means mounted on said frame; support plate means mounted on said guides means for vertical movement along said guide means; motor means associated with said support plate means for (1) positioning said support plate means vertically on said guide means along a first longitudinal axis, and (2) rotating said support means relative to said guide means about a second longitudinal axis substantially perpendicular to said first longitudinal axis; telescoping standard means for adjusting the length of same having one end integral with said support plates means and movable therewith and another free end; boom means fixed to the free end of said telescoping standard means; and drilling means mounted on said boom means for drilling along a third longitudinal axis wherein the location of said drilling means and angle of the third longitudinal axis is controlled by said motor means and said telescoping standard means.

2. An apparatus according to claim 1 wherein said guide means is pivotably mounted on said frame and movable between a horizontal position and a vertical position.

3. An apparatus according to claim 1 wherein said frame is provided with a second working unit wherein said second working unit comprises guide means mounted on said frame; support plate means mounted on said guide means for vertical movement along said guide means; motor means associated with said support plate means for (1) positioning said support plate means vertically on said guide means along a first longitudinal axis, and (2) rotating said support means relative to said guide means about a second longitudinal axis substantially perpendicular to said first longitudinal axis; telescoping standard means for adjusting the length of same having one end integral with said support plates means and movable therewith and another free end; boom means fixed to the free end of said telescoping standard means; and drilling means mounted on said boom means for drilling along a third longitudinal axis wherein the location of said drilling means and the angle of the third longitudinal axis is controlled by said motor means and said telescoping standard means.

4. A process for underground drilling of excavations comprising:

locating a hollow tube at an excavation site;

positioning a hollow rod coaxially within said hollow tube wherein a space is defined between said hollow rod and said hollow tube for receiving excavated material, said hollow rod being provided with boring means on one end thereof;

rotating said hollow tube and said hollow rod for excavating material from said excavation site by said boring means;

injecting a fluid mixture through said hollow rod into said excavation site proximate to said boring means during rotation of said hollow tube and said hollow rod wherein a portion of the excavated material is removed from the excavation site via said space between said hollow tube and said hollow rod and said fluid mixture admixes with the remaining portion of the excavated material for solidifying same; and removing the hollow rod from the excavation site after solidification of the admixed mixture.

5. A process according to claim 4 wherein said hollow tube and said hollow rod are rotated in opposite directions.

6. A process according to claim 4 wherein said injected fluid mixture causes deformation of a column of treated excavated material surrounding said hollow tube which stiffens.

7. A process according to claim 4 wherein said hollow tube is removed from the excavation site after solidification of the excavated material.

8. A process according to claim 4 including providing a plurality of nozzle outlets radially disposed on said hollow rod proximate to said boring means for delivering the injected fluid mixture to the excavated material in the excavation site.

9. A process for tunneling comprising drilling a plurality of excavations outlining a tunnel to be dug; locating a reinforcing tube having a longitudinal axis within each of said excavations, said reinforcing tube being provided with a plurality of one-way valves extending along the longitudinal axis thereof from an origin point to the end of said tube within said excavation site; feeding a solidifying mixture through said tube; and selectively opening said plurality of one way valves in sequence from the end of the tube to the origin point for feeding said solidifying mixture to the excavation site.

10. A process according to claim 9 including locating a hollow rod in said reinforcing tube and feeding said solidifying mixture through said hollow rod and providing a seal between the internal surface of said hollow tube and said hollow rod.

11. A process according to claim 9 wherein said one way valves comprise an elastic ring located in a slot provided on said hollow tube wherein a opening is provided for communicating the hollow slot with the inside of said hollow tube.

12. A process according to claim 11 wherein said elastic rings have a thickness less than or equal to the depth of the slot in which it is located.

13. A process according to claim 9 wherein said valves comprise a circular plate mounted said hollow tube for selectively sealing an opening communicating the interior of said hollow tube with said circular plate.

* * * * *